United States Patent [19]

Fogg

[11] 3,972,117

[45] Aug. 3, 1976

[54] DISPOSABLE COMBINATION STITCH PICKER AND SEAM RIPPER

[76] Inventor: Walter K. Fogg, Feeding Hills, Mass.

[22] Filed: Mar. 13, 1975

[21] Appl. No.: 557,974

[52] U.S. Cl. ..... 30/287; 30/294

[51] Int. Cl.[2] ..... B26B 29/02

[58] Field of Search ..... 30/286, 287, 289, 295, 30/294

[56] References Cited

UNITED STATES PATENTS

| | | | |
|---|---|---|---|
| 117,588 | 8/1971 | Woods | 30/289 X |
| 934,585 | 9/1909 | Trafford | 30/287 |
| 936,474 | 10/1909 | Post | 30/287 |
| 1,477,510 | 12/1923 | Martin | 30/287 |
| 2,610,399 | 9/1952 | Adams | 30/286 |
| 2,764,814 | 10/1956 | Jecker | 30/294 |
| 3,324,548 | 6/1967 | Mascia | 30/294 X |

*Primary Examiner*—James L. Jones, Jr.
*Assistant Examiner*—J. C. Peters
*Attorney, Agent, or Firm*—Charles R. Fay

[57] ABSTRACT

Disposable blade device having at one end a pair of spaced blunt, unsharpened projections joined by a concave sharpened area and having at its opposite end a blunt point and a narrow stitch picker with a concaved edge portion between them. This device is made from disposable razor blade stock or the like.

5 Claims, 3 Drawing Figures

DISPOSABLE COMBINATION STITCH PICKER AND SEAM RIPPER

BACKGROUND OF THE INVENTION

Single edged razor blades have often been used as seam rippers by domestic sewers and in the garment industry. Of course this razor blade has a dangerous exposed sharp edge which often plucks or cuts the fabric or the user.

There are commercial stitch pickers and seam rippers which include in general a rather sharp extending point for picking the stitch and another sharp point or sharpened longitudinal edge for ripping the seam. A sharpened longitudinal edge presents a hazard and the relatively sharp stitch picker is very apt to catch into the material when seam ripping and injure the material or even stick into the user's hand. With knit and double knit fabrics, this danger is even more pronounced as it is almost impossible to utilize such a device for seam ripping without engaging the sharp pointed stitch picker in the fabric and raising at least one thread damaging the fabric. It is the object of the present invention to provide an improved disposable stitch picker and seam ripper of general razor blade type by eliminating the shaving edge and recessing a concave curved cutting alcove for the purpose of ripping a seam and providing a stitch picking tool having a prong at the opposite end of the blade.

SUMMARY OF THE INVENTION

This invention provides a very inexpensive disposable razor blade type of device which comprises a narrow elongated blade, dull at both edges, with preferably a built up or additional member for a handle intermediate the ends thereof. The seam ripping end of the device is provided with a pair of extending dull rounded spaced projections neither of which will stick into the fabric or injure the user and having therebetween a sharpened concave alcove or the like, the sharpened edges of which are completely concealed. That is, they are not available to the fingers of the user, being completely protected by the two dull projections, one at either side of the concave sharpened area.

At the opposite end of the blade there is provided a stitch picking prong and a spaced dull rounded projection which will not stick into the fabric when using the prong as a stitch picker. A concave sharpened cutting area is situated in an alcove between the picking prong and the dull rounded projection.

The new stitch picker and seam ripper prevents snagging and puncturing the material because the stitch picker is isolated from the seam ripper, and the seam ripper per se cannot snag or puncture being used only for ripping seams. The device is extremely inexpensive and is completely disposable.

PREFERRED EMBODIMENT OF THE INVENTION

Figure 1:
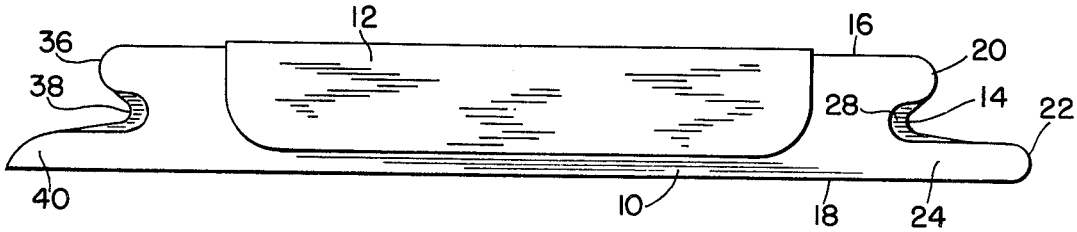
FIG. 1 is a plan view of the new stitch picker and seam ripper.

As shown in FIG. 1, an elongated narrow strip 10, which may be made of any suitable material for disposal thereof, is provided intermediate its ends with a folded-over leaf at 12 to rigidify the strip 10 and to act as a fingerhold or handle.

At one end of the device the strip is indented forming a concave curved alcove or the like 14 substantially midway of the edges 16 and 18 of strip 10, which edges are non-sharpened and are dull and safe for the fingers of the user as well as for the fabric.

The alcove 14 extends in a convex curve 20, preferably non-sharpened, intersecting edge 16. A similar convex dull edge 22 is provided on another projection 24 which is longer than the projection on which the dull edge 20 is provided.

However, the strip in the area of alcove 14 is sharpened as has been indicated at 28 providing a very sharp edge at the base or bottom of the alcove, which sharpened edge is completely protected in all directions because of the projections at either side thereof as clearly shown in FIG. 1. It is almost impossible for the user of the device to be cut on the fingers in the use of this device while ripping a seam.

Figure 2:
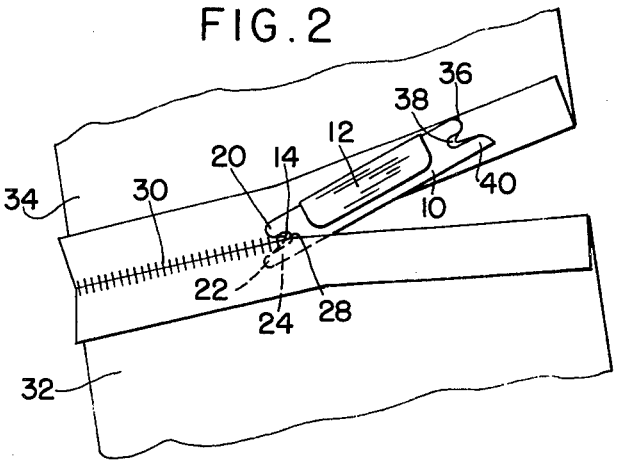
FIG. 2 is a perspective view illustrating the use of the same in ripping a seam.

The act of seam ripping is illustrated in FIG. 2 where the sharpened bottom 28 of the alcove 14 is illustrated as actually cutting the stitches indicated at 30 and forming a seam, between two pieces of material 32 and 34. In this case it will be seen that the elongated projection 24 is actually a guide extending at the other side of the seam 30 from the main body portion of the tool and the handle 12 which of course is held between thumb and forefinger of the party using the same. Obviously the dulled edges at 20 and 22 are incapable of snagging into the cloth no matter even if it is double knit, and therefore it is almost impossible for the operator to injure the cloth in any way, or to cut his fingers, the sharpened area 28 being guarded at both sides.

At the opposite end of the blade 10 there is another curved dull edge 36 adjacent the edge 16 of blade 10 rounding into a concave alcove 38 which may or may not be sharpened and terminating in an outwardly extending prong 40 which is reasonably sharp for picking stitches. It will be observed that although the seam ripper and the stitch picker are connected, they are isolated.

The present combined stitch picker and seam ripper may utilize a sense of touch to locate and cut "invisible" stitches preliminary to ripping the seam. Where the stitches are practically invisible because of stitch density or thread color the same as the material, locating the stitches may be quite difficult but this can be overcome by holding the seam between the thumb and index finger and then sliding the relatively sharp stitch picker along the seam stitches and between the plies of material where the thumb and index finger are holding the seam. The sense of touch will indicate when the point of the stitch picker has passed over a stitch, and then the operator stops and reverses the direction of the stitch picker so as to catch a stitch. A slight movement in a cutting direction will cut one or two stitches which is all that is necessary to then insert the projection 24 at the opposite end of the device and start ripping. In this way the device is also useful where the material is flimsy or soft. Transparent monofilm and threads used in the upholstery and garment industry are also difficult to use but are much more easily operated upon in the way stated by the use of the present invention.

Figure 3:
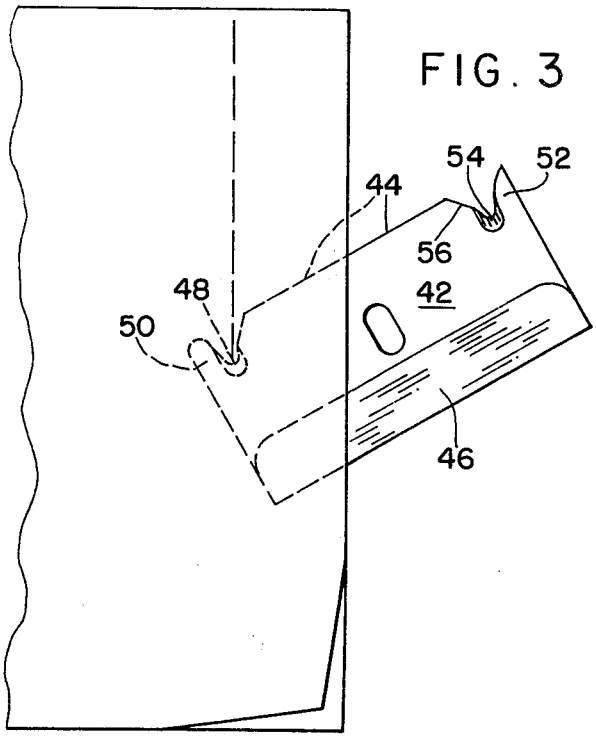
FIG. 3 shows a modification.

FIG. 3 illustrates a modification. The blade 42 has a dull edge 44 and a handle member 46. The seam ripper comprises the concave alcove 48 which is sharpened, and the dull projection 50 that acts both as a guard and a guide in a manner similar to that above described as to projection 24. The stitch picker is at the other end of the blade and is isolated from the ripper as before. The picker comprises prong 52, concave alcove 54, and the adjacent portion at 56 of the dull blade 42.

I claim:

1. A disposable combination stitch picker and seam ripper comprising a thin elongated disposable flat strip having dull side edges, a concave alcove formed at one end of the strip, a short projection at one side of the alcove and a longer projection at the other side thereof, both of these projections having rounded non-sharpened outer edges, a sharpened edge in the bottom of the alcove, said edge being concave and forming a cutting member, a relatively elongated pointed stitch picking prong at the opposite end of the strip, a second sharpened concave alcove adjacent thereto, and a forwardly projecting convexly curved dull member extending from the alcove to the edge of the flat strip opposite from the prong.

2. The combination of claim 1 wherein the projections extend in the same direction as the stitch picking prong.

3. The combination of claim 1 wherein the projections and stitch picking prong extend in opposite directions.

4. The combination of claim 1 including a reinforcing member arranged along a side edge of the flat strip and overlapping the latter.

5. The combination of claim 2 wherein the projections and stitch picking prong are located at one edge of the flat strip, and including a reinforcing handle member at the opposite edge of the flat strip.

* * * * *